United States Patent [19]

Rawolle

[11] 4,188,678

[45] Feb. 19, 1980

[54] NURSERY EQUIPMENT

[76] Inventor: Keith C. Rawolle, 33 Leslie St., Murray Bridge, Australia, 5253

[21] Appl. No.: 854,268

[22] Filed: Nov. 23, 1977

[30] Foreign Application Priority Data

Nov. 24, 1976 [AU] Australia ..... PC8247

[51] Int. Cl.[2] ..... A47C 7/02

[52] U.S. Cl. ..... 5/105; 5/443; 297/274; 297/438

[58] Field of Search ..... 5/101–105, 5/317 R, 327 R, 327 B, 62; 297/285, 274, 377, 457, 439

[56] References Cited

U.S. PATENT DOCUMENTS

| | | | |
|---|---|---|---|
| 2,751,970 | 6/1956 | Smith | 297/438 |
| 3,110,519 | 11/1963 | Chernivsky | 297/457 |
| 3,890,660 | 6/1975 | Pedler | 297/274 |

*Primary Examiner*—Casmir A. Nunberg

*Attorney, Agent, or Firm*—Oldham, Oldham, Hudak & Weber Co.

[57] ABSTRACT

An attachment for a bouncing cradle of a type described including a wire frame having a baby support U-shaped portion with a mesh across the baby support portion, and a base U-shaped portion the legs of the base shaped portion acting with the legs of the U-shape of the baby support portion in such a way as to provide resilient support for a baby in an inclined position, the attachment being characterized according to this invention by including a frame having at least two clamping means spaced apart and each positioned to engage with a releasable clamping action, a leg of the base portion, a portion of the frame extending forwardly and upwardly and a reaction member at an upper forward end of the frame adapted to provide a reaction pad against which a baby's feet can safely engage.

6 Claims, 3 Drawing Figures

NURSERY EQUIPMENT

This invention relates to apparatus useful for supporting babies and in general terms relates both to an attachment suitable for incorporation with known apparatus and a combination of the known apparatus with the improved arrangement.

BACKGROUND OF THE INVENTION

It is presently well known to support babies in an apparatus which is sold at least in Australia under a Trade Mark "Bouncinette".

A device of this type is shown in drawings attached to this specification but generally includes a frame comprised of one continuous length of wire which is shaped so as to have a lower U-shaped portion constituting a base an upper U-shaped portion constituting a baby support portion and the respect legs of the U-shaped portions joining at a forward end in such a way that the upper U-shaped portion is held at an inclined angle to the base portion when this is resting on the ground and with a baby resting on a cloth mesh supported by the upper U-shaped member, by inertial reaction, the baby can achieve a resilient bounce.

Such equipment is advantageous both from the point of view that it holds a baby in a relatively pleasant position from the babies point of view and some babies can amuse themselves by obtaining a resilient bouncing.

I have found however that a large number of babies do not obtain retain a resilient bouncing effect and very often therefore will become bored and must therefore be additionally amused.

I have found that children can amuse themselves for a much greater period of time by additions to apparatus of the type described, esepcially if this is made so that it can be adapted for particular children.

OBJECT OF THIS INVENTION

A main object of this invention is to provide apparatus suitable for attachment to a babies support device of the type described whereby to assist in keeping children amused and to make the baby support equipment of greater value.

A further object is to provide equipment that can be adapted to suit variations according to particular children that might use the baby support equipment.

A further object is to provide that equipment suitable as an attachment can be manufactured and therefore sold at a price which is economic in consideration of the present low cost of the equipment to which it is to be attached.

A further object is to provide that the attachment can be safe recalling that the equipment will exist with children and babies in the immediate vacinity and yet at the same time the attachment must be able to be manufactured economically.

A further object is to provide that the attachment can be secured to the baby support equipment in such a way that it will be stable and maintain its position even when subjected to substantial reaction by a baby.

STATEMENT OF THE INVENTION

The invention can be said to reside in an attachment to be joined in a releasable manner to a baby support apparatus of the type described the attachment being formed so as to have two spaced apart portions adapted to engage with gripping engagement a base of the baby support device and the attachment having its frame then extending forwardly and upwardly and terminating at a uppermost position with a reaction pad against which a baby's feet can safely engage.

In studying many babies using the baby support device, I have noticed that many like to feel something firm against the soles of their feet and when they feel such a firm reaction, will tend to press against this which of course is an ideal reaction to assist babies in learning to develop their muscles for the next stage of growing and walking.

It is important however to recall that babies are of many different sizes and it is important that the baby generally by itself will feel and at first tentative test the reaction before becoming more confident and therefore obtaining great advantage from the reaction.

It is therefore important that the reaction member be adjustable in position relative to the upper U-shaped member of the baby support device and this is achieved by having the spaced apart portions adapted to engage with a releasable gripping engagement and this implies because the legs of the base portion of the baby support device are generally parallel that the relative position of a reaction pad can be adjusted to quite specifically suit each individual baby.

The invention can therefore be said to reside in an attachment for a bouncing cradle of a type described including a wire frame including a baby support U-shaped portion adapted to support, with a soft mesh across the said portion, a baby in an inclined position, the baby support portion being supported by a base U-shaped portion adapted to be ground engaging the legs of the base portion being substantially parallel one with the other and joining at each end with the legs of the baby support portion whereby to provide resilient interconnection between the said two portions the invention being characterized according to this invention in that the attachment comprises a frame having at least two clamping means spaced apart and each positioned to engage with a releasable clamping action a side member of the base portion, a portion of the frame extending forwardly and upwardly and a reaction member at an upper forward end of the frame adapted to provide a reaction pad against which a baby's feet can safely engage.

One of the difficulties is to provide an apparatus of this type that is very economically manufacturable and furthermore is compatible with the type of device to which it is to be attached.

A further form of the invention can therefore be said to incorporate an attachment suitable for attachment to a bouncing cradle of the type described the attachment being characterized according to this invention by including a frame having one wire member shaped to have at both ends a U-shaped clamping portion the planar direction of the U-shape being transverse to a forward direction, and the open mouth of the U-shape in each case being innermost as compared to the base of the U-shape, a lower leg of each U-shape at an innermost position extending in a forward direction and adapted to be horizontal in position and ground engaging, and, at a forwardmost end, rising to an uppermost position and extending transversely to join with the other side of the wire member, holding means to hold closed the open mouth of the U-shaped clamping portion to effect a clamping action on the side member of the base portion of the baby support, and a reaction member supported at the upper outer end of the frame adapted to provide a reaction pad against which a baby's feet can safely engage.

This particular construction has substantial advantage in that it is comprised in the main of one single wire member which is simply bent into the required shape and there need only be minimal members such as the reaction member and the two holding means which in their simplest form simply comprise C-shaped wire pieces or O-shaped wire pieces. The reaction member in its simplest form simply comprises a tubular member having a slot along the axial direction of the tubular member and this is simply frictionally fitted over the uppermost U-shape of the frame.

The invention can also reside in the combination of a bouncing cradle baby support device of the type described in combination with an attachment in which the gripping or clamping portions are appropriately secured one to each leg of the U-shaped base portion and the attachment is so positioned that it has a forward upper portion with a reaction member thereby positioned generally in line with the inclined baby support portion of the baby support and adapted whereby to enable the baby's feet to safely engage against this.

DESCRIPTION OF PREFERRED EMBODIMENT

Figure 1:
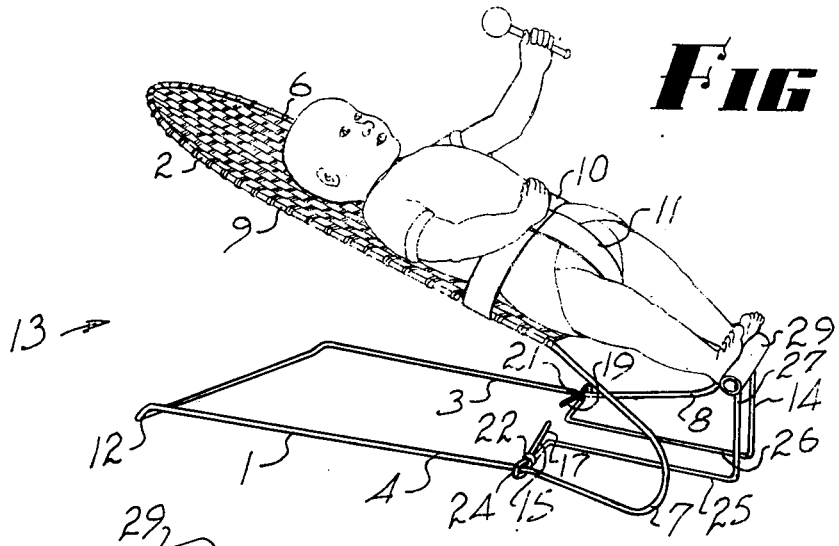

The invention will now be described with the assistance of drawings in which:

FIG. 1 is a perspective view of a baby support and having an attachment according to the preferred embodiment attached hereto the drawing in particular showing the way in which a baby will position itself and locate its feet against a reaction member of the attachment.

Figure 2:
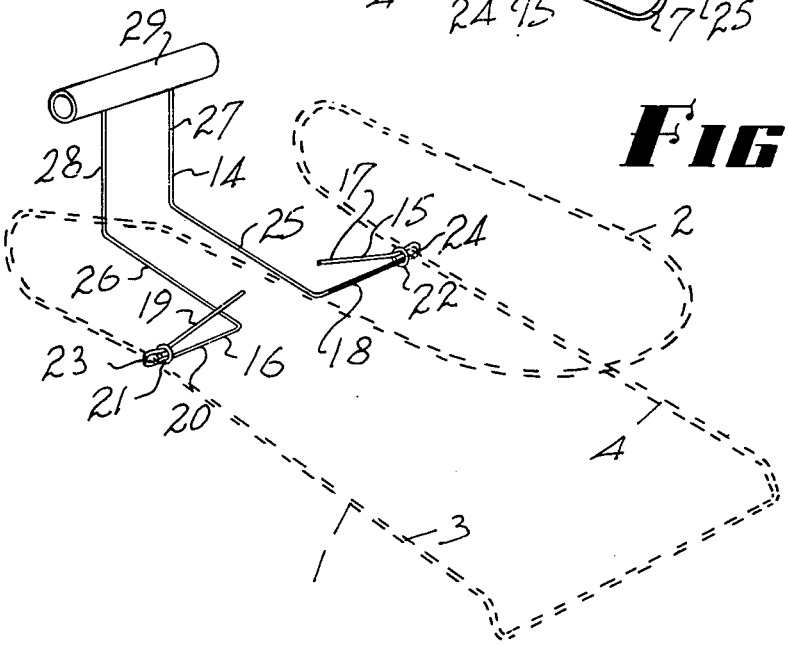
Figure 3:
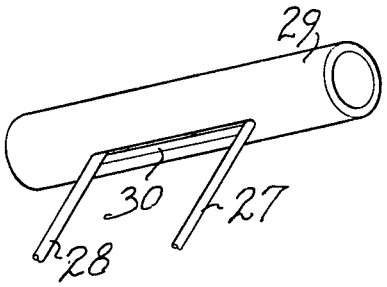

FIG. 2 is a perspective view from an opposite side of the view as shown in FIG. 1 in this case however the baby support being only a frame and shown in dotted lines and the attachment being shown separately in hard lines, and FIG. 3 is an underneath view of the reaction member of the attachment showing in particular the way in which the frame of the attachment member is inserted into a slot within a tubular section of the reaction member.

Referring now in detail to the drawings the baby support which is of a type that is presently well known and commonly sold at least in Australia and in overseas countries is constituted by firstly a frame formed from a single wire member into the shape as is shown.

This in particular includes a base portion 1 generally of U-shape a baby support portion 2 also of U-shape and the legs 3 and 4 of the base portion joining with the legs 5 and 6 of the baby support portion 2 in a manner to provide a further U-shape portion on each side these being shown at 7 and 8 which has its open mouth rearwardly positioned.

Positioned to slip around the frame of the baby support portion 2 is a cloth mesh member 9 and this includes a webbing belt 10 and a crutch support 11 which holds a baby securely in position and of course inclined generally as is shown in the drawings.

It will be seen that the base of the U-shaped member 1 is slightly downwardly bent this being shown at 12 and this has the effect of slightly raising the legs 3 and 4 so these are slightly above the ground and the whole of the baby support 13 then rests on a forward end of the legs 3 and 4 and at a rearward end at 12.

The attachment 14 is made, in the main, from one single piece of wire which is bent into the shape as shown.

The wire member firstly has its ends 15 and 16 to be generally of U-shape these constituting in each case clamping portions the planar direction of each of the U-shapes 15 and 16 being transverse to a forward direction which is generally defined as being in a direction closer to the child's feet as compared to its head.

The reason the direction is transverse to this forward direction is that in this way the legs 3 and 4 will be able to be ensnared between the legs 17 and 18 in the one case and 19 and 20 in the other and by engaging the ring 21 in the one case and 22 in the other to hold leg 19 close to leg 20 in the one case and leg 17 close to leg 18 in the other there will effected a clamping action.

It will be noticed that at the base of each of these U-shaped members 16 and 15 the wire has been slightly reduced in diameter by grinding which has been considered necessary to assist in a good pivotal at this point and thereby to assist in a good gripping action. This ground off portion is shown at 23 and 24.

The lower leg 18 in the one case and 20 in the other has the shape at its end of the wire then extending forward this being a portion shown in the one case as 25 and the other 26 which will at least at least at its forward end be ground engaging and of course generally horizontal and at a forwardmost end the shape in each case is inturned so as to be generally vertical to rise as portions 27 and 28 and at the uppermost end both portions turn toward each other and are commonly connected to thereby provide generally and upturned U-shape.

The reaction member 29 is comprised of a tubular platic member which has a slot 30 cut therethrough the slot being in the direction of the axial direction of the tube 29 and the sides of the slots 30 being such that it will closely fit the diameter of the wire which is inserted therethrough and therefore hold this tightly.

This then describes then in general terms the preferred embodiment.

It will now be seen that what has been described both as an attachment by itself or by the combination of an attachment with a baby support device provides a substantial improvement for apparatus for babies which will assist in their development.

It will be furthermore seen that the apparatus is both very economical to produce and very safe in relation to babies and most particularly is adapted to be fully adjustable in position relative to the baby support portion of the baby support device to enable a baby to be best suited to gain this reaction experience.

It is to be noted that in the preferred embodiment there is some advantage in putting niches along legs 19 and 17 so as to hold the ring 21 or 22 in position. Such niches are not shown in the drawing but can be used and are of an advantage.

I claim:

1. An attachment for a bouncing cradle of a type described including a wire frame having a baby support U-shaped portion with a support layer extending across the baby support portion, and a base U-shaped portion, the base U-shaped portion having legs acting with the legs of the U-shape of the baby support portion in such a way as to provide resilient support for a baby and to support the baby in an inclined position, the attachment being characterized according to this invention by including a frame having at least two clamping means spaced apart and each positioned to engage with a releasable clamping action a leg of the base portion, a portion of the wire frame extending forwardly and upwardly, a reaction member at an upper forward end of the frame adapted to provide a reaction pad against which a baby's feet can safely engage; and the frame having one wire member shaped to have at both ends a U-shaped clamping portion the planar direction of the U-shape being transverse to a forward direction, whereby to provide a releasable clamping action engaging the side leg of the base portion, and the open mouth of the U-shape in each case being innermost as compared to the base of the U-shape, a lower leg of each U-shape at an innermost position being the portion that extends forwardly and upwardly this first extending in a position substantially horizontal and adapted to be at least in part ground engaging, and at a forwardmost end rising to an uppermost position and then extending transversely to join with the other side of the wire member, and holding means to hold closed the open mouth of each U-shaped clamping portion to effect a clamping action on the respective leg of the base portion of the baby support device.

2. An attachment according to claim 1 in which the reaction member comprises an elongated member secured to extend transversely across the top of the frame.

3. An attachment (as characterized) according to claim 1 having each of its clamping means engaging a leg of the base portion of the baby support device and having its reaction member spaced apart but generally in line with the inclined baby support portion of a baby support device.

4. An attachment for a bouncing cradle of a type described including a wire frame having a baby support U-shaped portion with a support layer extending across the baby support portion, and the wire frame having a base U-shaped portion the legs of the base shaped portion acting with the legs of the U-shape of the baby support portion in such a way as to provide resilient support for a baby in an inclined position, the attachment being characterized according to this invention by including a second frame having at least two spaced apart end clamping means each positioned to engage with a releasable clamping action a leg of the base portion, a portion of the second frame extending forwardly and upwardly and a podal reaction member at an upper forward end of the second frame adapted to provide a reaction pad against which a baby's feet can safely engage.

5. An attachment according to claim 4, wherein said podal reaction member comprises an elongated member positioned to extend transversely across a top portion of said second frame.

6. An attachment according to claim 4, wherein each of said frame-formed clamping means adjustably engage a leg of the base portion of the wire frame so as to enable placing said podal reaction member at variable distances from the resilient support layer of the bouncing cradle.

* * * * *